US006186776B1

(12) United States Patent
Myerchin

(10) Patent No.: US 6,186,776 B1
(45) Date of Patent: Feb. 13, 2001

(54) BIRTHDAY CANDLE IGNITION SYSTEM

(76) Inventor: Christian P. Myerchin, 10910 NE. 151st St., Bothell, WA (US) 98011

( * ) Notice: Under 35 U.S.C. 154(b), the term of this patent shall be extended for 0 days.

(21) Appl. No.: 09/385,218

(22) Filed: Aug. 27, 1999

(51) Int. Cl.[7] ..... F23D 3/16
(52) U.S. Cl. ..... 431/287; 431/289; 431/295
(58) Field of Search ..... 431/287–295, 431/325; 362/161; 102/310, 320, 360, 361; 44/519

(56) References Cited

U.S. PATENT DOCUMENTS

| | | | |
|---|---|---|---|
| 988,257 | 3/1911 | Doody | 431/288 |
| 1,911,161 | 5/1933 | Morrison | 431/295 |
| 2,196,509 | 4/1940 | Turner | 431/295 |
| 2,223,228 | 11/1940 | Schisanto et al. | 431/295 |
| 2,302,146 | 11/1942 | Root et al. | 431/291 |
| 2,818,714 | 1/1958 | Inns | 431/290 |
| 3,204,433 | 9/1965 | Bureau | 431/295 |
| 3,388,960 | 6/1968 | Cangialosi | 431/288 |
| 3,730,674 | 5/1973 | Gross | 431/288 |
| 3,754,861 | 8/1973 | Sadahiro | 431/289 |
| 3,826,606 | 7/1974 | Hicks | 431/295 |
| 4,324,763 | 4/1982 | Jarman | 431/295 |
| 4,334,853 | 6/1982 | Gardner | 431/295 |
| 4,381,914 | 5/1983 | Ferguson | 431/289 |
| 4,721,455 | 1/1988 | Barfus | 431/295 |
| 4,835,663 | 5/1989 | Abbott et al. | 431/320 |
| 5,344,309 | 9/1994 | Phare | 431/289 |
| 5,354,197 | 10/1994 | Barone | 431/287 |
| 5,439,376 | 8/1995 | Kramer et al. | 431/295 |
| 5,567,145 | 10/1996 | White | 431/288 |

FOREIGN PATENT DOCUMENTS

| | | | | |
|---|---|---|---|---|
| 2424958 | * | 11/1889 | (FR) | 431/288 |
| 922635 | * | 6/1947 | (FR) | 431/295 |
| 17467 | * | of 1889 | (GB) | 431/288 |
| 46421 | * | 3/1984 | (JP) | 431/295 |

OTHER PUBLICATIONS

Lacroix Eugene #226, Italy, 1870, p. 229.*

* cited by examiner

*Primary Examiner*—James C. Yeung
(74) *Attorney, Agent, or Firm*—Cislo & Thomas LLP

(57) ABSTRACT

A candle ignition system for substantially simultaneously lighting multiple candles includes a fuse of a fast-burning material and intermediate igniter members extending transversely from the fuse. The igniter members have a first portion for connection to the fuse and a second portion for attachment to candle wicks. In one embodiment, the igniter members have a large surface area in relation to their thickness. The igniter members may be separate from the fuse and formed into a loop for passing a fuse therethrough, or may be integral or unitary with the fuse. Preferably, the igniter members fold over and sandwich the candle wicks between the folds. Wax or other tacky substance is used for attachment to the wicks. The first portion may be a fast-burning portion relative to the second portion which may burn slower, or the second portion may burn hotter than the first portion.

46 Claims, 5 Drawing Sheets

FIG. 1
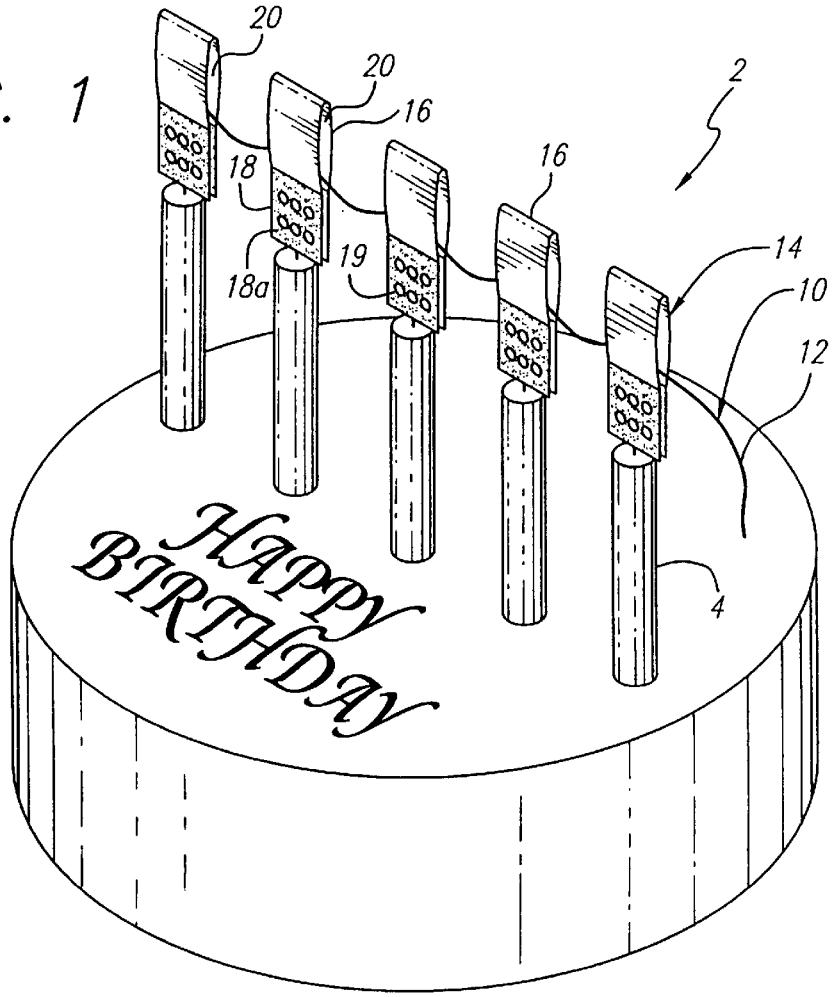
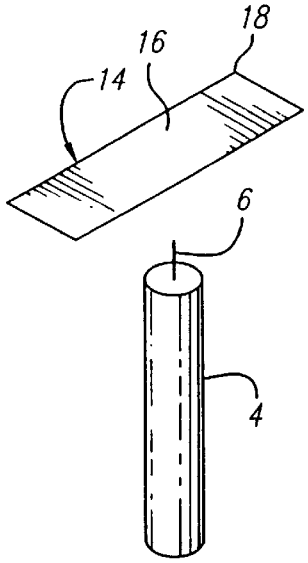
FIG. 2
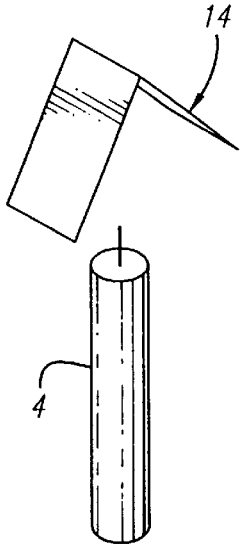
FIG. 3
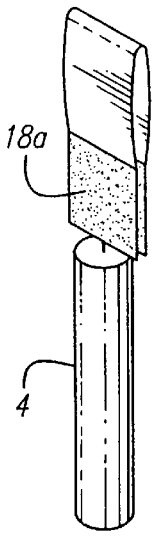
FIG. 4
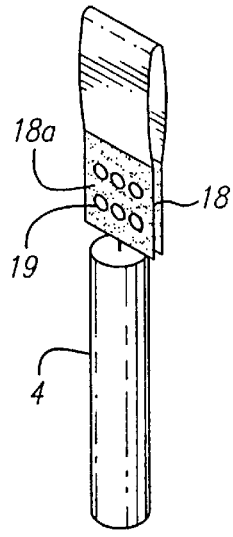
FIG. 5

BIRTHDAY CANDLE IGNITION SYSTEM

BACKGROUND OF THE INVENTION

The present invention relates to a birthday candle ignition system, and more specifically to an ignition system using an intermediate member between the fuse and wick.

Birthday cakes with candles representing the number of years of the birthday person are an age-old tradition. Lighting all of the candles before presenting the cake to the birthday person is part of this tradition. Where there are more than just a few candles, it is difficult to light all the candles sufficiently rapidly to avoid substantial melting of the candles and getting wax on the cake. In addition, the task of lighting the candles itself is tedious and runs the risk of burning the lighter's hand.

Birthday candle ignition systems for lighting all of the candles quickly, by means of lighting a fuse connected to all of the candles have been proposed. For example, U.S. Pat. No. 5,354,197 to Barone discloses an ignition system where each candle is formed relatively flat and with a flared upper portion. A hole is bored through the upper portion and a fuse is threaded through each hole in each candle wick. Each end of the fuse is provided with a ball or nut acting as a stopper. The igniting fuse may be formed of thread-like material such as cotton or cotton blends and be coated or impregnated with wax to burn at a controlled rate. One problem with such a system is that special candles with special wicks must be provided. It is also tedious to thread the fuse through each candle wick. In addition, the lighting process may be serial as the fuse is set to burn at a controlled rate. If there are a lot of candles, this could take a long time. Moreover, there is a significant chance that the fuse will extinguish along the way, and thus fail to light all of the candles.

U.S. Pat. No. 5,439,376 to Kramer et al. discloses using a fuse to ignite multiple candles by attaching the fuse to the top of the candle and bending the wick until it touches the fuse. In one embodiment, each candle may have an igniting fuse, and the igniting fuses may then be interconnected. The drawbacks of this system are that one must attach the fuse to the top of the candle using melted wax. Because the fuse is thin and long, this may be a weak connection and come loose, causing the candle to be bypassed during the ignition process. In addition, the wick must be bent over to touch the fuse and held in that position. Moreover, the fast-burning fuse may not provide sufficient time to kindle the wick. In the embodiment using individual fuses, each fuse and wick must still be tied or connected together, which appears to be a tedious process. If each fuse burns quickly, the system is also subject to the same problem of ensuring ignition of the candle wick.

What is needed is a fast-burning fuse with a quick and simple mechanism to attach to standard candle wicks which ensures lighting of each of the wicks.

SUMMARY OF THE INVENTION

In one embodiment, the ignition system provides an igniter fuse, preferably of a highly combustible material such as a nitrocellulose material, cotton with a nitrated polymer, or other "nitrated material," and an intermediate igniter member attached to each candle wick. The invention thus provides a two-stage ignition system: the fast-burning fuse to light all of the intermediate igniter members, and the igniter members to light the candles.

The igniter members preferably extend transversely from the fuse to connect to the wicks. The igniter members are preferably made of a comparable material to the igniter fuse, and folded over to form a loop through which the fuse passes.

In a more preferred embodiment, the intermediate igniter members also have a slower-burning portion where they attach to the wick, e.g., by use of melted wax or a tacky substance. The fuse is threaded through the intermediate igniter members where they have been folded over. The igniter members also preferably have a wide cross-section (large length and width providing a large surface area) substantially greater than their thickness and that of a typical fuse or the candle wick, to simplify attachment to the wick and to ensure kindling of the wick.

In another embodiment, the intermediate igniter members are integral or unitary with the fuse and fold over a horizontal axis as in the first embodiment. In a third embodiment, the intermediate igniter members are also integral or unitary with the fuse and fold over a vertical axis.

In a further embodiment, the igniter members have a small magnesium wire or other hot and fast-burning portion such as a nitroparaffin or nitrostarch coating on their wick-attaching portions.

BRIEF DESCRIPTION OF THE DRAWINGS

FIG. 1 is a perspective view of a birthday cake with multiple candles and a fuse and intermediate igniter members in accordance with the invention;

FIG. 2 is a side perspective view of one candle and one intermediate igniter member of the type shown in FIG. 1 for illustrating a process of attaching the intermediate igniter member in accordance with the invention;

FIG. 3 is a view similar to that of FIG. 2, illustrating a second step in the process;

FIG. 4 is a view similar to FIG. 2 illustrating a third step in the process;

FIG. 5 is a view similar to FIG. 2 illustrating a fourth step in the process;

DETAILED DESCRIPTION OF THE PREFERRED EMBODIMENT(S)

Figure 6:
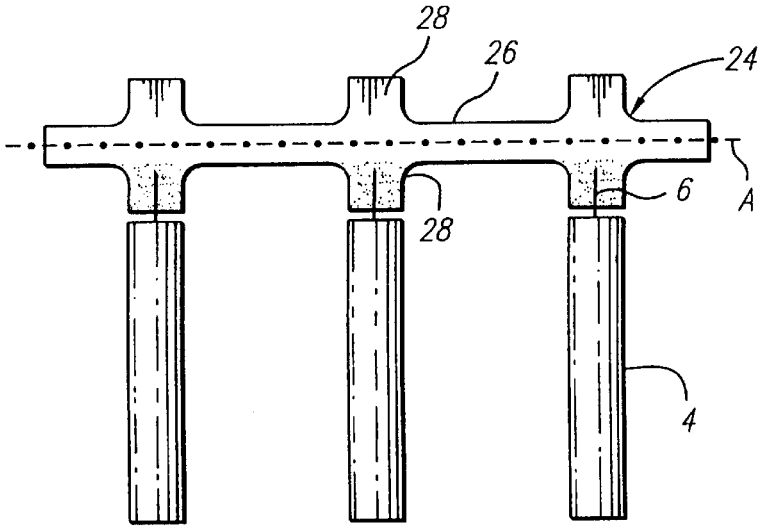
FIG. 6 is a side view of some candles and a fuse and intermediate igniter members in accordance with a second embodiment of the invention showing in a first step in an assembly process in accordance with the invention.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequence may be accomplished by different embodiments that are also intended to be encompassed within the spirit and scope of the invention and the claims thereon.

With reference to FIG. 1, a cake 2 has a plurality of candles 4 each having a wick 6. The cake, for example, may be a birthday cake. A fuse assembly 10 in accordance with the invention includes a fast-burning elongate fuse 12 and intermediate igniter members 14 for each candle 4. The fuse is preferably a thin cord of nitrocellulose, a cotton with a nitrated polymer, or other fast-burning material. The intermediate igniter member 14 is preferably a piece of material which is the same or similar to the fast-burning material in the fuse 12. However, in the ignition system, the intermediate igniter may have several forms. In this embodiment, the igniter member 14 has two portions. There is a fast-burning portion 16 and a slow-burning portion 18.

The fast-burning portion has a loop 20 through which the fuse may readily be threaded. The fast-burning portion 16 may be constructed of the same or similar material as the fuse is constructed. It will ignite quickly in response to the burning of the fuse, even though the fuse burns quickly. The slower-burning portion 18 is attached to the candle wick 6 to ensure that the wick will kindle. The igniter member is relatively large in cross-section (large length and width providing a large surface area) in relation to its own thickness and to the fuse and the candle wick to ensure that the slow-burning portion is ignited and thus ensure that the candle wick will be ignited. This wide or relatively substantial surface area, particularly where constructed with a very narrow depth or thickness provides some assurance of kindling and also a relatively quick and easy mechanism to attach to the candle wick. That is, the intermediate igniter member may be folded to provide loop 20 for easy threading of the fuse. Because the intermediate member is separate from the fuse, the candles may be located at any spacing in any desired pattern.

To achieve the slower-burning portion of the intermediate igniter member, it may be made from the same material as the other portion of the intermediate igniter member, but the slower burning portion is impregnated or coated with wax or other slower burning substance relative to the fuse and the fast-burning portion. This wax is preferably tacky so that the igniter member can attach to itself and to the candle wick by folding over.

Figure 12:
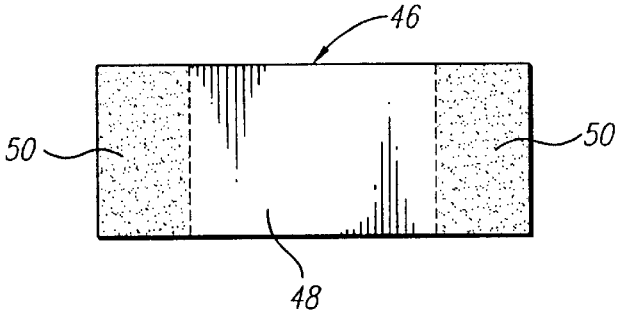
FIG. 12 is an enlarged view of an intermediate igniter member in accordance with a fourth embodiment of the invention.

A method of attaching the intermediate igniter member is shown in FIGS. 2 through 5. As mentioned above, the igniter member has a substantially rectangular shape with a large surface area in relation to its thickness. The slower-burning portion 18 corresponds to the end regions of the igniter member 14 and the fast-burning portion corresponds to the middle. However, the igniter member of FIG. 2 has not yet had wax applied to it, although that could be done at any appropriate point during the process. As shown in FIG. 3, the igniter member is than folded over itself. As shown in FIG. 4, the igniter member's upper portion is formed into a loop and the lower portion sandwiches the wick. It is preferred to get wax 18*a* from a candle on the lower portion of the igniter member to form the slower-burning portion and to help the igniter member adhere to the candle and itself. The area adjacent the wick of the candle may be heated to soften the wax. One must take care, though, not to heat it so much that the candle ignites. As shown in FIG. 5, the bond strength between the wick and the igniter may be enhanced by pressing or forming holes 19 through both sides of the igniter member. Alternatively, as shown in FIG. 12, an igniter member 46 may be provided in advance with a soft wax 50 or other tacky suitable substance to adhere to itself and the wick with the wick therebetween and to form fast-burning portion 48 and a slow-burning portion at the wax 50.

As in all embodiments, the slower-burning portion of the igniter burns sufficiently slowly to allow time for the wick to ignite before the igniter expends itself.

With this structure, lighting one end of the fuse will cause all the candles to be ignited by rapidly igniting all of the fast-burning portions of the igniter members, and then allowing the slower-burning portions to kindle and ignite each candle. Nitrocellulose is preferred for the fuse and at least the first fast-burning portion of the igniter member as it burns rapidly and leaves no ash or other residue. It also burns brightly providing an interesting display.

In accordance with a second embodiment of the invention, the fuse and intermediate igniter members are integrally or unitarily formed. Preferably, the fuse and intermediate igniter members are made from the same material as in the previous embodiment. The combination fuse and igniter members 24 are formed by a long sheet of rapidly-burning material having a central long section (fuse) 26 and flaps or tabs 28 spaced apart forming igniter members. The tabs 28, as in the prior embodiment, have a high surface area-to-thickness ratio and a relatively large width and length in relation to their depth. Also as in the previous embodiment, the tabs 28 of the igniter member are folded over and adhered to the wick and themselves, preferably by melted wax 31 from the candle. However, these tabs 28 may be provided with a tacky substance in advance, including wax.

Figure 7:
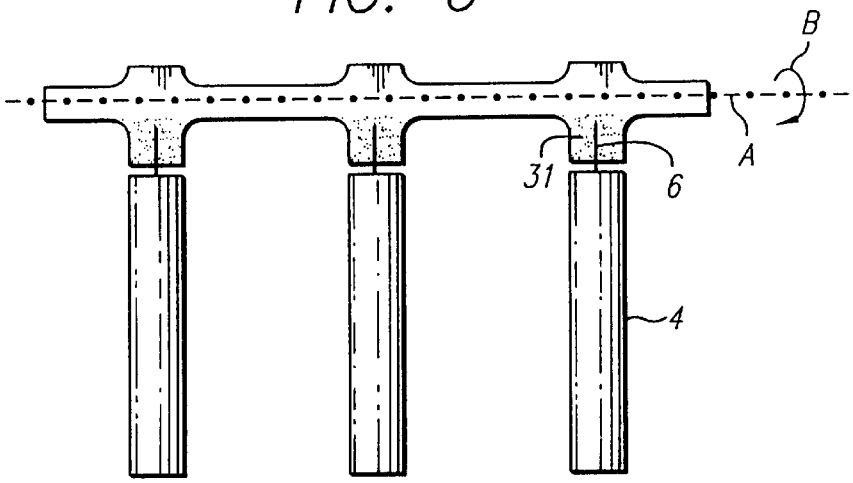
FIG. 7 is a view similar to FIG. 6 showing a second step in the process of FIG. 6.
Figure 8:
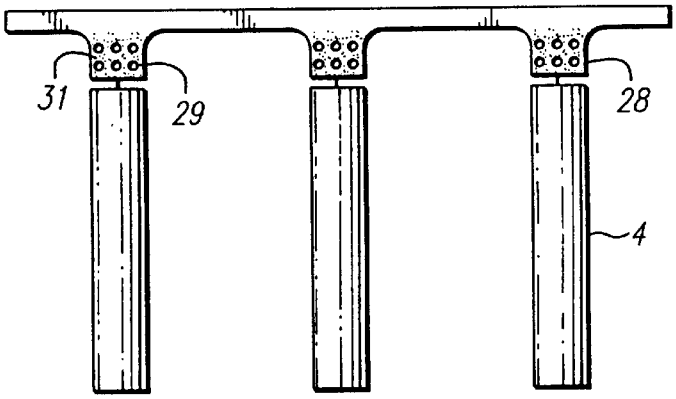
FIG. 8 is a view similar to FIG. 6 showing a third step in the process.

FIG. 6 shows an unfolded state of the tabs and fuse. FIG. 7 shows a partially folded state in the direction of arrow B about axis A. FIG. 8 shows the fully folded and attached state. As in the previous embodiment, the bond between the wick and tabs of the intermediate igniter member may be strengthened by punching holes 29 through the tabs.

Figure 9:
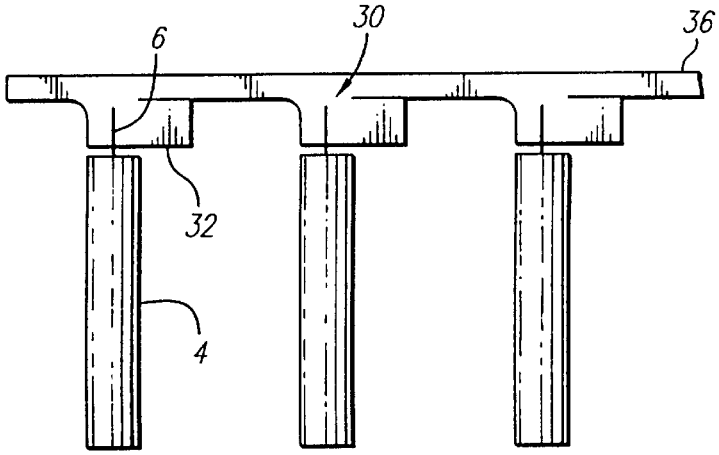
FIG. 9 is a view similar to FIG. 6 illustrating a third embodiment of the invention in a first step in the assembly process.
Figure 10:
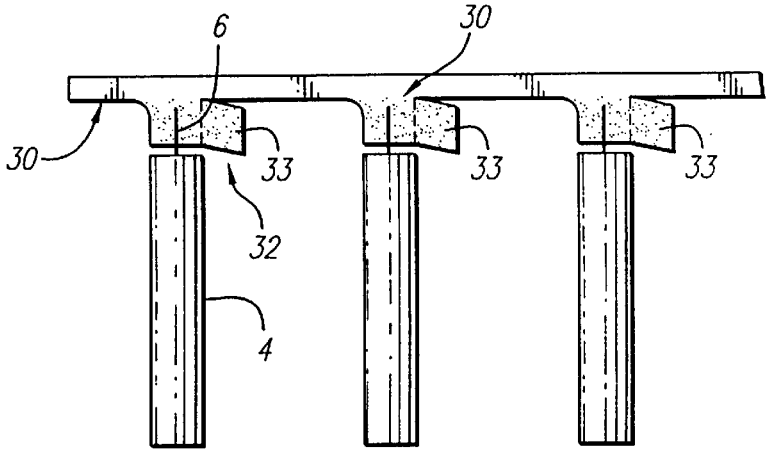
FIG. 10 is a view similar to FIG. 9 showing a second step in the assembly process.
Figure 11:
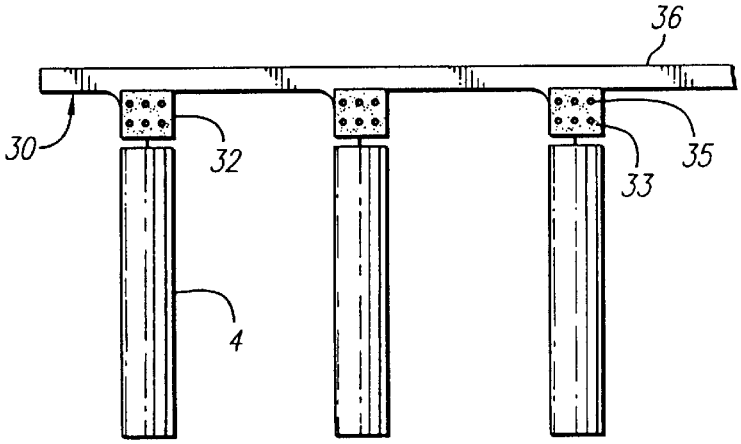
FIG. 11 is a view similar to FIG. 9 showing a third step in the process.

The embodiment of FIGS. 9–11 is similar to that of FIGS. 6–8 except that tabs 32 are provided on one side of the combination igniter member/fuse 30, and the tabs fold over themselves about a vertical axis. The long portion 36 of the combination fuse/igniter member 30 forms the fuse. As in the previous embodiments, the tabs 32 may be impregnated or coated with wax 33 by heating the top of the candle, or combined in advance with wax or another tacky substance which creates a slower-burning portion. To increase bond strength, holes 35 may be pressed or formed through the folded tabs.

Figure 13:
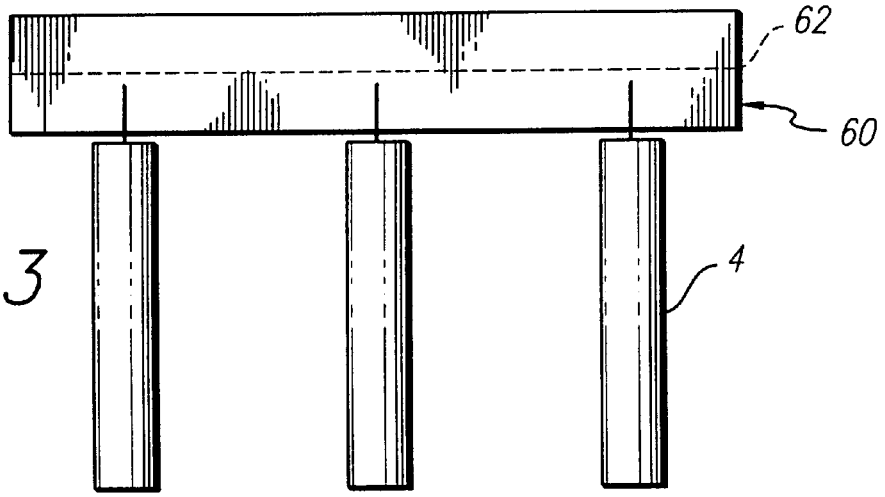
FIG. 13 is a side schematic view of some candles and a fuse and intermediate igniter members in accordance with a fifth embodiment of the invention showing a first step in an assembly process in accordance with the invention.
Figure 14:
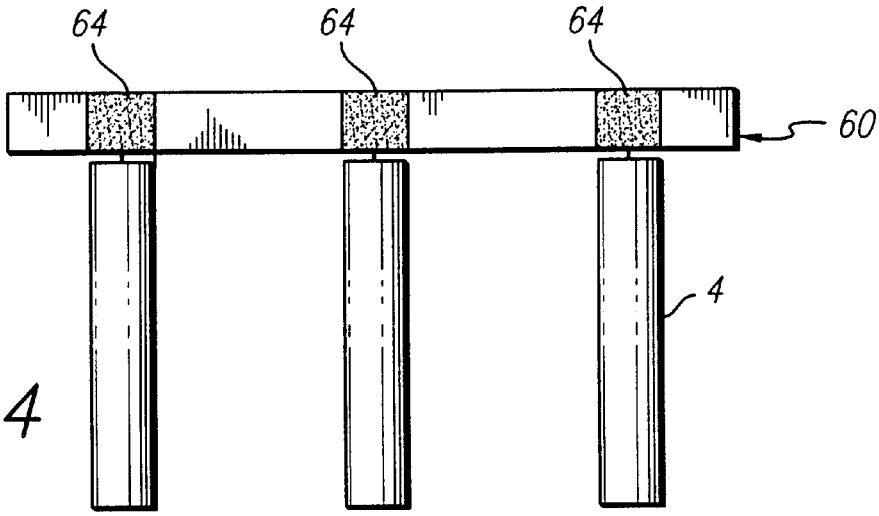
FIG. 14 is a view similar to FIG. 13 showing a second step in the process.

In accordance with another embodiment of the invention, FIG. 13 shows a long thin nitrocellulose or other fast-burning material which is a combination fuse and igniter member 60. The combination fuse 60 is folded over at dotted line 62 to provide a folded combination fuse as shown in FIG. 14. Portions of the combination fuse are provided with wax or other tacky substance to attach to each candle wick. The area provided with wax or other tacky substance provides a slower-burning portion 64 and thus an integral or unitary igniter member 64.

Figure 15:
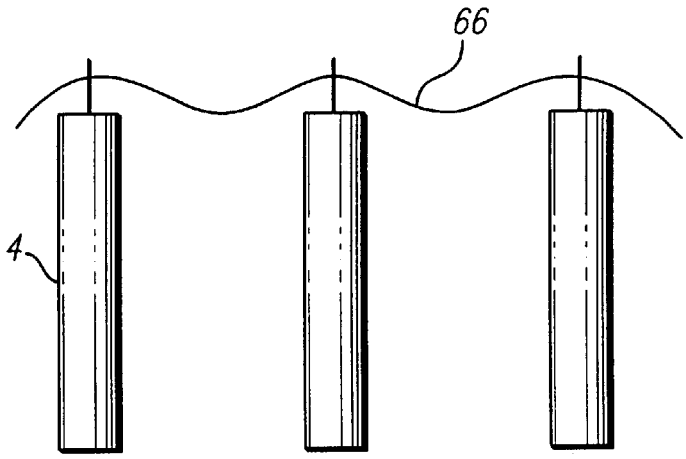
FIG. 15 is a view similar to FIG. 13 of a sixth embodiment of the invention showing a first step in an assembly process in accordance with the invention.
Figure 16:
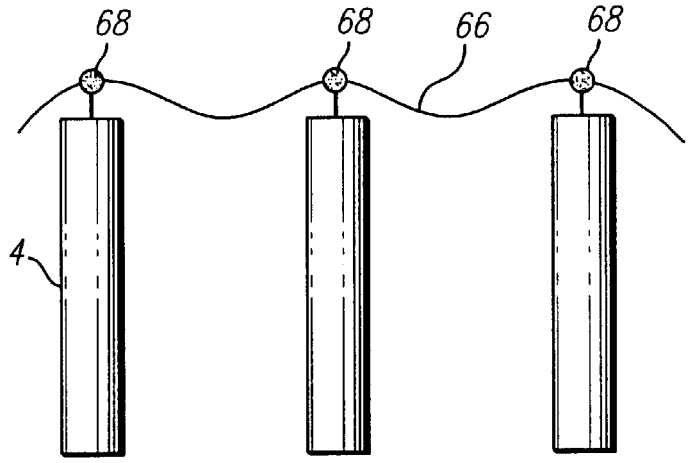
FIG. 16 is a view similar to FIG. 15 showing a second step in the process.

In accordance with a further embodiment of the invention as shown in FIG. 15, a long thin strip fuse 66 is shown. A shown in FIG. 16, igniter members 68 are provided by a sheet material with a relatively large surface area in relation to the fuse being folded over the fuse and wick. The igniter members 68 are provided with wax or other tacky substance to make this connection, and this may also serve to provide a slower-burning intermediate member.

Figure 17:
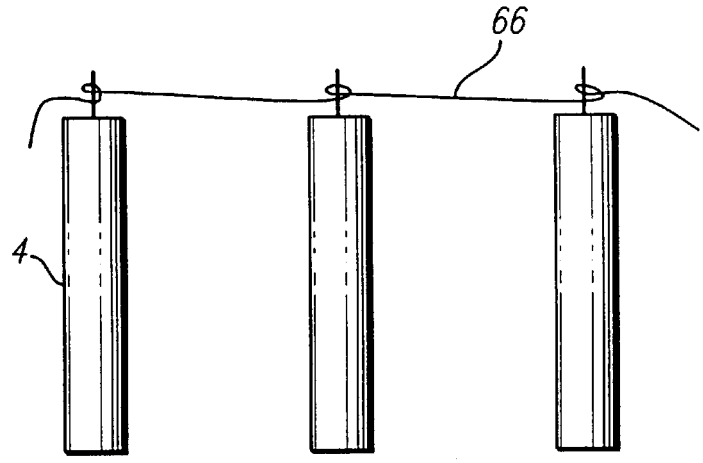
FIG. 17 is a view similar to FIG. 15 showing a modification of the process.

As shown in FIG. 17, the process may be modified by winding the fuse 66 around each candle wick for an even more secure connection.

The foregoing embodiments may be modified by using an intermediate igniter member which is the same material as or a different material from the fuse, but without creating a slower-burning portion of the intermediate igniter member. The wax, or another tacky substance, or other means of connecting the intermediate igniter member to the candle wick may be used without creating the slower-burning portion. In fact, the intermediate igniter member may consist of a fast-burning portion which is the same or substantially the same as the fuse, and an even faster-burning (or other speed) portion made by using a small magnesium wire, a nitroparaffin or a nitrostarch coating on the lower portion of the igniter member instead of wax as long as this wick-attaching, faster-burning portion burns hot to ensure kindling of the wick.

The invention provides a two-stage approach to lighting candles. The first stage is the fuse, and the second stage is the igniter members which extend transversely from the fuse for attachment to and ignition of the wicks. The igniter members are readily ignited by the fuse, so that the fuse can rapidly, and with high probability, light all of the igniter members. Then, all of the igniter members in turn individually light each candle wick. The use of the slower-burning lower portion of the igniter members, i.e. the portion which is proximate the candle wick, provides sufficient kindling time to ensure lighting the candle wick. However, it is also possible to use even faster burning substances proximate the candle wick, particularly where they burn hot to help ensure kindling the candle wick. That is, this material would be highly exothermic in relation to the fuse material or to the other portion of the igniter member.

While the present invention has been described with regards to particular embodiments, it is recognized that additional variations of the present invention may be devised without departing from the inventive concept.

What is claimed is:

1. An ignition system for a plurality of candles, comprising:

an elongate fuse comprising a fast-burning material; and a plurality of igniter members each comprising a first portion having means for connecting to the fuse, and a second portion for attaching to and igniting a candle wick.

2. The ignition system of claim 1, wherein the first portion of the igniter members comprises a fast-burning material and the second portion of the igniter members comprises a slower-burning material relative to the fast-burning material.

3. The ignition system of claim 2, wherein the fast-burning material and the fast-burning portion are selected from a group consisting of nitrocellulose and a nitrated material, and the slower burning portion comprises wax combined with the same material as the fast-burning portion.

4. The ignition system of claim 2, wherein each of the igniter members comprises a unitary sheet of material, and the slower-burning portion comprises the material combined with wax.

5. The ignition system of claim 2, wherein there are means for attaching the slower-burning portion to itself and the candle wick by wax, and holes are formed through the slower-burning portion.

6. The ignition system of claim 1, wherein the means for connecting comprises a loop.

7. The ignition system of claim 6, wherein the loop is formed by folding the igniter member.

8. The ignition system of claim 1, wherein the igniter members each have a large surface area in comparison with their depth and a thickness of the fuse.

9. The ignition system of claim 1, wherein the igniter members each have a large width and a large length in comparison with their depth and a thickness of the fuse.

10. The ignition system of claim 1, wherein the means for connecting the fuse and the igniter member comprises a unitary connection of the fuse and igniter member.

11. The ignition system of claim 10, wherein the fuse and the igniter members comprise a long sheet and each of the igniter members further comprises at least one tab extending transversely to a length of the sheet.

12. The ignition system of claim 11, wherein each of the igniter members comprises two tabs folded together.

13. The ignition system of claim 11, wherein each of the igniter members comprises one tab folded over itself.

14. The ignition system of claim 10, wherein the second portion comprises a region having wax and wherein the fuse and the igniter members have a large surface area sufficient for being folded over.

15. The ignition system of claim 1, wherein the igniter members extend substantially normal to the fuse.

16. The ignition system of claim 1, wherein the second portion of the igniter members comprises a material which burns highly exothermically in relation to the first portion of the igniter member.

17. The ignition system of claim 1, wherein the first portion and the second portion of the igniter members have different rates of burning.

18. The ignition system of claim 1, wherein the igniter members extend transversely from the elongate fuse.

19. The ignition system of claim 1, wherein the fuse comprises a long thin strip material and the igniter members comprise a thin sheet material for folding over a candle wick and the fuse.

20. A method of lighting multiple candles substantially simultaneously, the method comprising the steps of:

providing a fuse of fast-burning material;

providing intermediate igniter members;

for each candle, connecting the igniter members between the fuse and a wick of the candle; and igniting the candles by lighting the fuse, whereby the fuse burns and the igniter members are lit by the fuse and separately light each wick.

21. The method of claim 20 wherein the igniter members comprise a first portion and a second portion which burn at different rates, the first portion burning fast and the second portion burning slower relative to the first portion, and the step of connecting for each candle comprises a step of connecting the fast-burning first portion to the fuse and the slower-burning second portion to the wick.

22. The method of claim 21, wherein the igniter member comprises a sheet of material and the step of connecting the fuse and the igniter member comprises a step of folding the sheet to form a loop and passing the fuse therethrough.

23. The method of claim 22, wherein the fuse and the sheet are connected by a step of forming the fast-burning portion unitary with the fuse.

24. The method of claim 23, wherein the step of connecting the fuse and the igniter member is performed by folding the igniter member.

25. The method of claim 20, wherein the step of connecting the igniter member to the wick comprises a step of applying wax to the igniter member to make the second portion a slower-burning portion relative to the first portion and folding the igniter member so that the wax adheres the igniter member to itself and the wick.

26. The method of claim 25, wherein the step of connecting the igniter member to the wick includes forming holes through the slower-burning portion of the igniter member.

27. The method of claim 20, further comprising a step of forming the igniter members with a first portion for connection to the fuse and a second portion for connection to the wick, the second portion comprising a material which burns hotter than the first portion for igniting the wick.

28. The method of claim 20, further comprising a step of extending the igniter members transversely from the fuse.

29. The method of claim 20, wherein the fuse and igniter members are integrally provided as a long sheet of material, and the step of connecting comprises integrally forming the igniter members with the fuse, folding the fuse and igniter members over each candle wick and providing wax on the igniter members.

30. The method of claim 20, wherein the fuse is a long thin strip material and the igniter members each comprise a thin sheet material with a relatively large surface area in relation to the fuse, and the step of connecting comprises folding the igniter members over the strip material and fuse.

31. The method of claim 30, wherein the fuse is wrapped around the wick.

32. An ignition system for a plurality of candles in combination with the candles, the combination comprising:

a plurality of candles each having a wick;

an elongate fuse comprising a fast-burning material; and a plurality of igniter members connected to the fuse and wick and comprising a first portion having means for connecting to the fuse, and a second portion having means for connecting to and igniting the wick.

33. The combination of claim 32, wherein the first portion of the igniter members comprises a fast-burning material and the second portion of the igniter members comprises a slower-burning material relative to the fast-burning material.

34. The combination of claim 33, wherein the fast-burning material and the fast-burning portion are selected from a group consisting of nitrocellulose and a nitrated material, and the slower burning portion comprises wax combined with the same material as the fast-burning portion.

35. The combination of claim 34, wherein each of the igniter members comprises a sheet of fast-burning material.

36. The combination of claim 32, wherein the igniter members each have a large surface area in comparison with their depth and a thickness of the fuse.

37. The combination of claim 32, wherein the igniter members each have a large width and a large length in comparison with their depth and a thickness of the fuse.

38. The combination of claim 32, wherein the igniter members extend substantially normal to the fuse.

39. The combination of claim 32, wherein the second portion of the igniter members comprises a material which burns highly exothermically in relation to the first portion of the igniter members.

40. The combination of claim 32, wherein the first portion and second portion of the igniter members have different rates of burning.

41. The combination of claim 32, wherein the means for connecting the fuse and the igniter member comprises a unitary connection of the fuse and igniter member.

42. The combination of claim 41, wherein the fuse and the igniter members comprise a long sheet and each of the igniter members further comprises at least one tab extending transversely to a length of the sheet.

43. The combination of claim 41, wherein the second portion comprises a region having wax, wherein the fuse and igniter members have a large surface area, and wherein the fuse and igniter members are folded over for connecting each of the igniter members to the fuse.

44. The combination of claim 32, wherein the igniter members extend transversely from the wick.

45. The combination of claim 32, wherein the fuse comprises a long thin strip material and the igniter members are folded over for connecting to the fuse and wick.

46. The combination of claim 45, wherein the fuse is wrapped around the wick.

* * * * *